US006056122A

United States Patent [19]

Takeuchi

[11] Patent Number: 6,056,122

[45] Date of Patent: May 2, 2000

[54] TRANSPORTABLE STORAGE CONTAINER

[75] Inventor: Shinobu Takeuchi, Adachi-gun, Japan

[73] Assignee: Moldec Co., Ltd., Adachi-gun, Japan

[21] Appl. No.: 09/134,165

[22] Filed: Aug. 14, 1998

[30] Foreign Application Priority Data

Jul. 13, 1998 [JP] Japan ..... 10-197103

[51] Int. Cl.[7] ..... B65D 19/00

[52] U.S. Cl. ..... 206/597; 206/386; 206/710

[58] Field of Search ..... 206/305, 386, 206/583, 598, 597, 710; 220/675

[56] References Cited

U.S. PATENT DOCUMENTS

| | | | |
|---|---|---|---|
| 3,901,406 | 8/1975 | Kivett | 220/675 |
| 3,987,829 | 10/1976 | Leone | 220/675 |
| 4,013,170 | 3/1977 | Hutterer | 206/583 |
| 4,027,794 | 6/1977 | Olson | 206/583 |
| 4,757,900 | 7/1988 | Misset et al. | 206/597 |
| 4,903,827 | 2/1990 | Phelps et al. | 206/583 |
| 5,133,460 | 7/1992 | Shuert | 206/386 |
| 5,366,090 | 11/1994 | Schutz | 206/599 |
| 5,611,452 | 3/1997 | Bonora et al. | 206/710 |
| 5,860,549 | 1/1999 | Allers et al. | 220/675 |

FOREIGN PATENT DOCUMENTS

| | | | |
|---|---|---|---|
| 2118139 | 10/1983 | United Kingdom | 206/386 |

*Primary Examiner*—David T. Fidei
*Attorney, Agent, or Firm*—Oblon, Spivak, McClelland, Maier & Neustadt, P.C.

[57] ABSTRACT

A transportable storage container includes a box-like cover member having an opened bottom portion, a base member provided under the cover member so as to mount an expensive heavy article such as a metallic mold, and buckles for connecting detachably the cover member and the base member whereby the metallic mold held in the container is protected from rusting due to invasion of water; a space for storing is effectively utilized by stacking a plurality of containers; movement of the container in which the metallic mold is housed is easy by a carrier for exclusive use; and an easier transportation of the container is obtainable when it is transported by a forklift or is transported on the bed of a truck.

11 Claims, 11 Drawing Sheets

TRANSPORTABLE STORAGE CONTAINER

BACKGROUND OF THE INVENTION

1. Field of the Invention

The present invention relates to a transportable storage container for storing metallic dies, metallic parts, a precision machine or a measuring instrument in a factory or a warehouse, and adapted to be transported by a carrier.

2. Description of the Related Art

Generally, a metallic mold for molding a plastic product or a metallic mold for stamping a metallic sheet is heavy and is usually expensive because of being precisely finished. Accordingly, it should be treated carefully. Various kinds of metallic molds are used in any molding plant. Since metallic molds have different sizes and shapes and are heavy, it is not easy to storage them orderly, and they are often placed carelessly on the floor or racks in the molding plant. Further, metallic molds are sometimes left in an exposed state. In this case, a rust-proof oil is applied to the metallic molds so as to prevent them from getting rusty. Since the rust-proof oil affects adversely to an injection-molded product, the rust-proof oil must to be removed by cleaning before use.

Further, when a metallic mold is moved from a storage site to a treating site or a side of a molding machine, the metallic mold is placed on a pallet, and then, the pallet is moved by using a transporting machine such as a forklift, a lifter, a carrier or a crane. In this case, however, it occasionally takes time to wait for the carrier, the crane or the like. Further, since the metallic mold is placed in an exposed state, there is a danger of being damaged due to contact with another metallic mold or an instrument during transportation of the metallic mold. Further, it is considered that the metallic mold gets wet by invasion of water into the molding plant due to a flood disaster or by fire fighting activities. In this case, the metallic mold gets rusty and it may not be able to be used.

Generally, drawings and maintenance records for metallic molds and parts or tools for producing the metallic molds and spare parts are stored or transported separately from the metallic molds. Accordingly, they have to be located any time when they are needed. Further, they are sometimes lost.

When a metallic mold is transported to another molding plant, it must be packed by using a wooden frame, a corrugated fiberboard and cushion members so as to meet the size of the metallic mold. In addition, the drawings and spare parts for the metallic mold had to be packed. The packaging works were troublesome. Further, it took time to open the package, and there is a problem of disposing of the packaging materials.

SUMMARY OF THE INVENTION

It is an object of the present invention to provide a transportable storage container suitable for storing an expensive heavy product such as metallic dies, metallic parts, a precision machine, a measuring instrument or the like and being adapted to prevent occurrence of rust and invasion of water due to a flood disaster or fire fighting activities.

It is another object of the present invention to provide a transportable storage container which facilitates orderly arrangement by stacking a plurality of storage containers whereby a space can effectively be used.

It is another object of the present invention to provide a transportable storage container capable of transporting a heavy product such as metallic dies from a storage site to another place or a side of a molding machine in a state of housing the heavy article in the container whereby damage to the article can be prevented, or capable of transporting stably the heavy article housed in the container even when the container is transported by a forklift or a carrier.

In accordance with an aspect of the present invention, there is provided a transportable storage container for an expensive heavy article comprising a box-like cover member having an opened bottom portion, a base member provided under the cover member so as to mount an article thereon and a connecting means for connecting detachably the cover member to the base member.

In the above-mentioned transportable storage container, a recess is formed in an upper face of the cover member and a projection, which corresponds in shape to the recess, is formed in a lower face of the base member.

Further, in the above-mentioned transportable storage container, the cover member is flared downward.

Further, in the above-mentioned transportable storage container, room is formed in side the cover member to hold drawings or parts.

Further, in the above-mentioned transportable storage container, a waterproof sheet is attached to an upper face of the base member to wrap the article from its lower portion.

Further, in the above-mentioned transportable storage container, a carrier member is detachably attached to or is formed integrally with a lower portion of the base member.

In the above-mentioned transportable storage container provided with the carrier member, casters are provided at a bottom of the carrier member so as to be retractably and rotatably by eccentric shafts or pivotal shafts.

In the transportable storage container provided with a carrier member, grooves capable of accommodating forks of a forklift are formed at a bottom face of the carrier member.

DETAILED DESCRIPTION OF THE INVENTION

Figure 1:
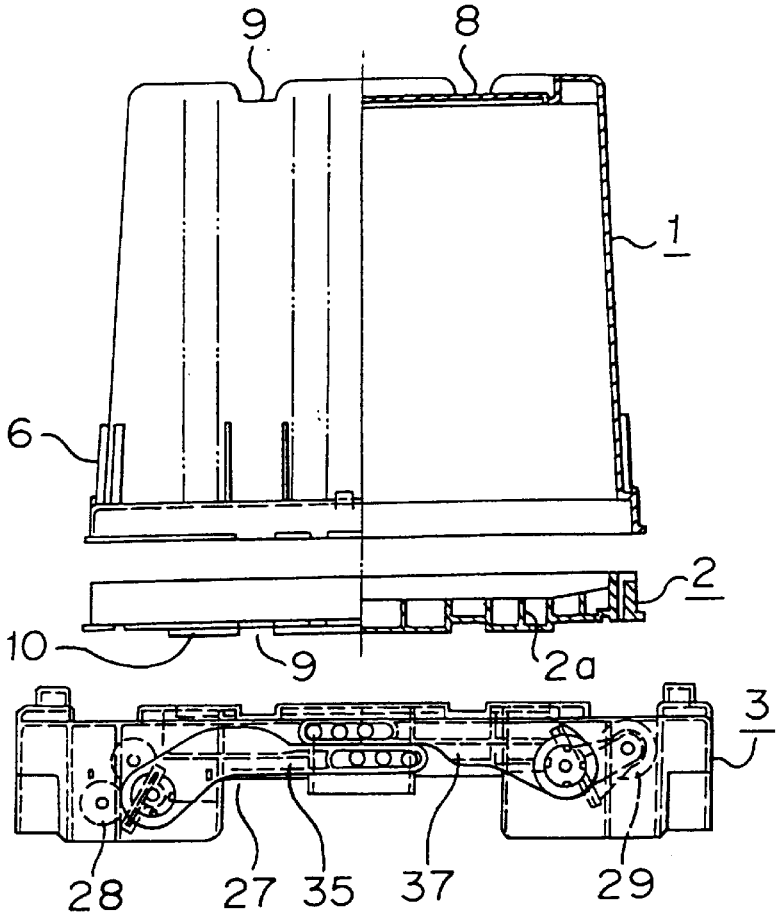
FIG. 1 is a front view of an embodiment of the transportable storage container according to the present invention wherein a cover member, a base member and a carrier member are shown in a disassembled state.
Figure 2:
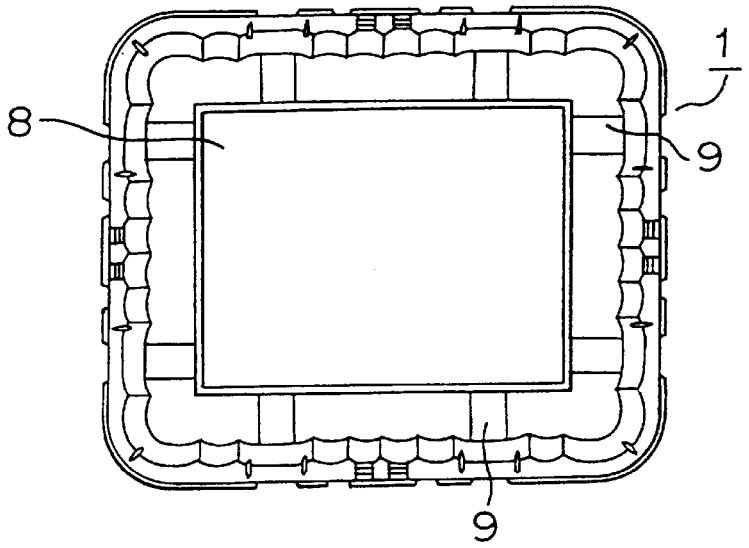
FIG. 2 is plan view of the cover member shown in FIG. 1.
Figure 3:
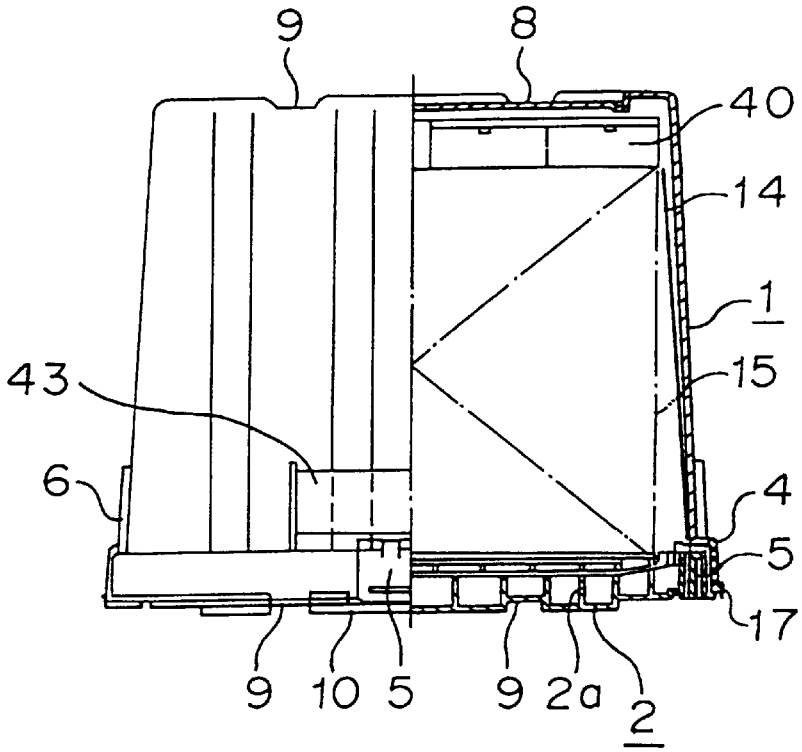
FIG. 3 is a side view partly cross-sectioned through the cover member and the base member in an assembled state.

A preferred embodiment of the transportable storage container of the present invention will be described in more detail with reference to FIGS. 1 to 15. In FIG. 1 there are a box-like cover member, 1 and a base member for supporting the cover member 1 from its lower portion. A carrier member 3 transports the base member 2 along with the cover member 1, these members 1–3 being made of plastics. The cover member 1 has a box-like shape with its lower side opened and is flared toward its lower side as shown in FIG. 3. The peripheral edge at a lower portion of the cover member 1 is extended outwardly to form an extension so that buckles 5 as a connecting means can be engaged with intermediate portions between extensions 4.

Each side surface of the box-like cover member 1 is corrugated and has a plurality of ribs 6 which project from a lower portion of the cover member 1 to a certain extent of height so that the strength of the cover member 1 can be increased. A rectangular recess 8 is formed in an upper face of the cover member 1. A plurality of grooves 9 for winding bands are formed between the recess 8 and the peripheral portion of an upper portion of the cover member 1 as shown in FIG. 2.

The base member 2 is formed to be a generally flat shape in which reinforcing ribs 2*a* are formed to intersect perpendicularly in an upper portion of the base member 2. As well shown in FIG. 1, a rectangular projection 10 is formed in a lower face of the base member 2 to be fitted to the rectangular recess 8 shown in FIG. 2 and formed in the upper face of the cover member 1. Grooves 9 for winding bands are formed transversing the projection 10 at positions corresponding to the grooves 9 formed in the cover member 1.

Figure 4:
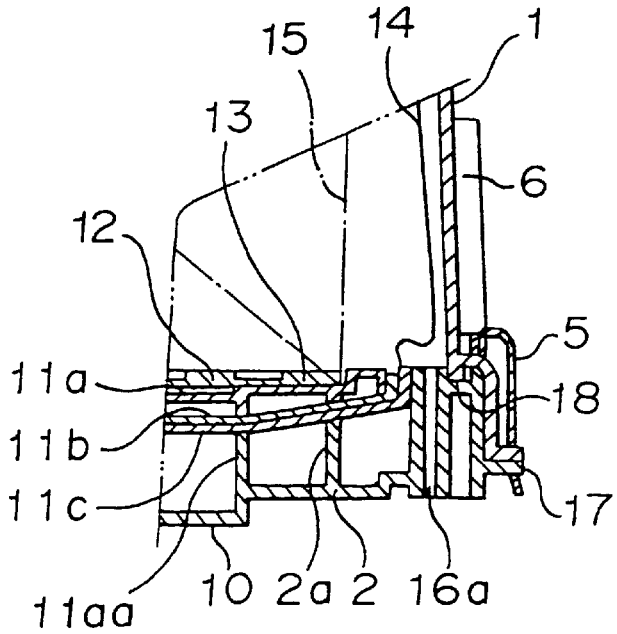
FIG. 4 is an enlarged cross-sectional view of FIG. 3, which shows a connecting portion between the cover member and the base member.

As shown in FIGS. 3 and 4, a central portion of the perpendicularly intersecting ribs 2*d* formed in an upper portion of the base member 2 is recessed downward. In the recessed portion, three disc-like plates 11*a*, 11*b*, 11*c* are provided in a stacked form. Further, in a central portion of the plate 11*a* which is placed at the uppermost position, a nonslip mat 13 in which nonslip projections 12 are formed is provided.

The uppermost plate 11*a* is made of a hard plastic material and an intermediate plate 11*b* and a lower plate 11*c* are made of a soft sheet. A flexible waterproof sheet 14 of generally square shape is fixed between the plates 11*b*, 11*c* by clamping its central portion so that the waterproof sheet 14 can wrap a metallic mold 15 placed on the nonslip mat 13 from its lower portion toward its upward edge. Perpendicularly intersecting ribs 11*aa* are formed in a lower face of the uppermost plate 11*a*, and the perpendicularly intersecting ribs 11*aa* are in a face-to-face relation to the perpendicularly intersecting ribs 2*a* formed in the base member 2 so as to provide a cushion effect whereby the waterproof sheet 14 is protected.

Band insertion openings 16*a* are formed near the outer periphery of the base member 2 so as to penetrate it vertically. The band insertion openings 16*a* are adapted to pass packaging bands therethrough so that the metallic mold 15 placed on the base member 2 is immovably fixed. A U-groove 18 is formed in the periphery of an upper portion of the base member 2. The base member 2 is further provided at its lower portion with projections 17 on which the lower periphery of the cover member 1 rests and permits the buckles 5 to engage therewith whereby the cover member 1 is coupled with the base member 2.

Figure 5:
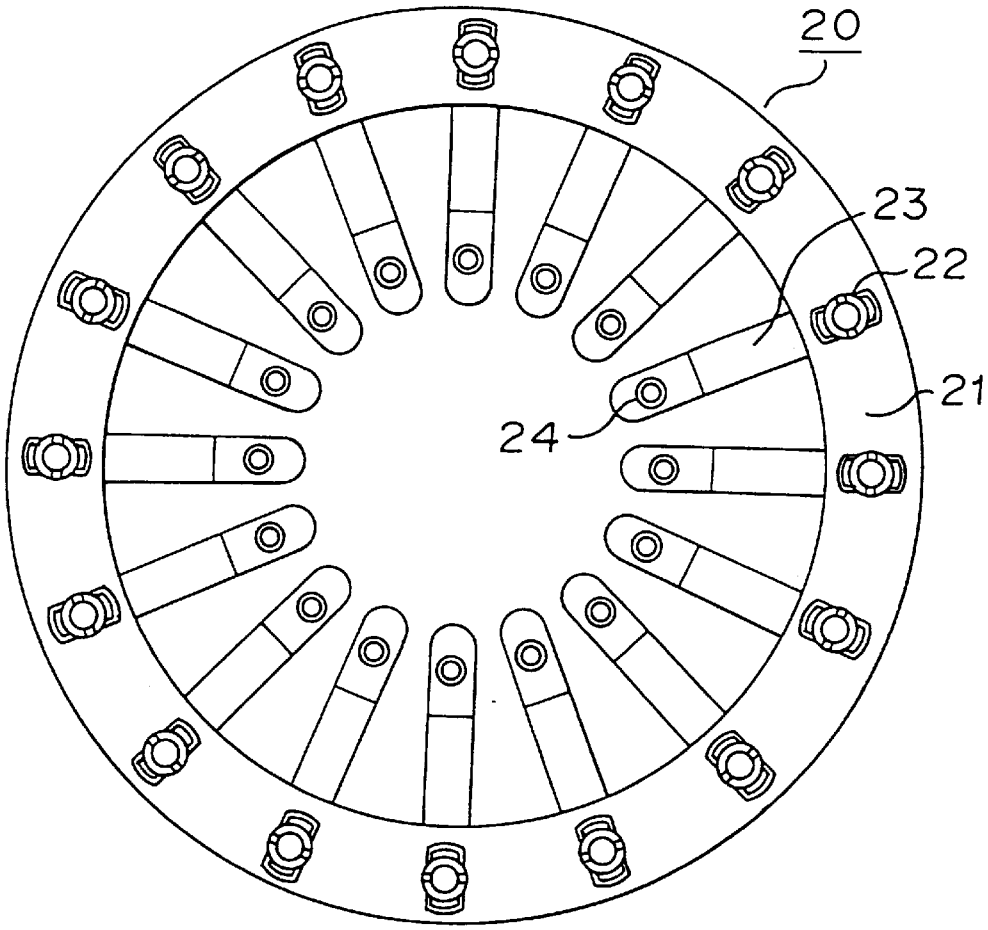
FIG. 5 is a plan view of a sheet fitting tool.
Figure 6:
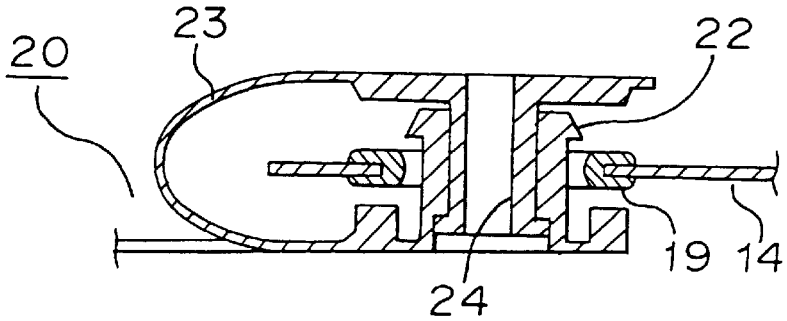
FIG. 6 is an enlarged cross-sectional view showing the sheet fitting tool by which a waterproof sheet is retained.
Figure 7:
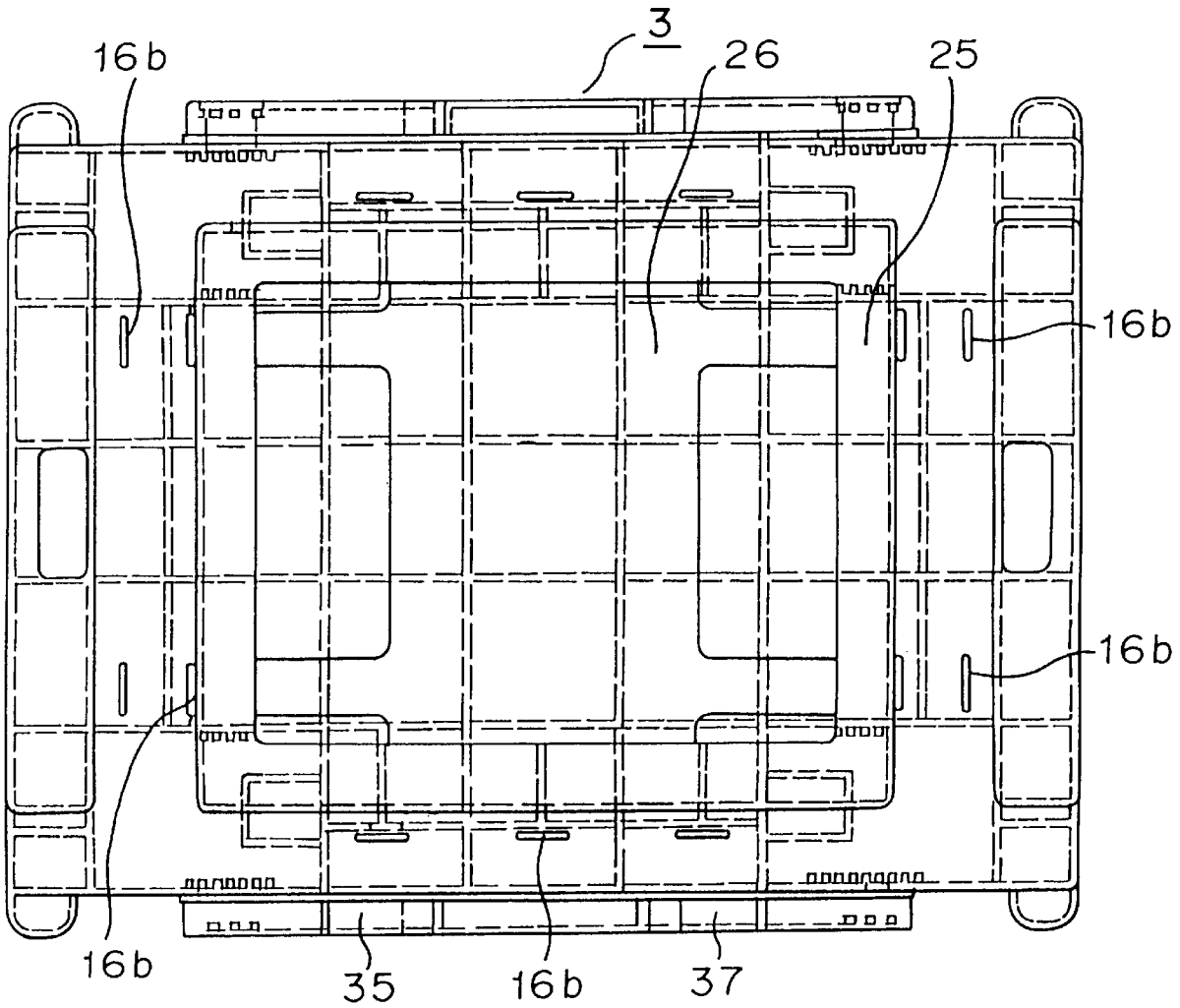
FIG. 7 is a plan view of an embodiment of the carrier member.

The waterproof sheet 14 has a generally square shape which is enough to develop from the lower portion of the mold 15 toward the top in the inside of the cover member 1, and the sheet 14 is provided with eyelet rings 19 with predetermined intervals at its side edges as shown in FIG. 6. FIG. 5 is a plan view of a sheet fitting tool 20 which comprises a ring portion 21, a plurality of strip pieces 23 radially extended from the ring portion 21 to the center of it wherein radially outer portions of the strip pieces 23 are connected to the ring portion 21 with predetermined intervals by tubular insertion pieces 22 and the other ends are provided with a tubular insertion pin 24. The carrier member 3 in FIG. 7 comprises a generally flat frame-like body in which perpendicularly intersecting ribs are formed. Further, the carrier member 3 is provided at its central portion of an upper face with a rectangular frame 25 to which the rectangular projection 10 of FIGS. 3 and 4 formed in a lower face of the base member 2 can be fitted. In the rectangular frame 25, a recess 26 is formed.

At outer sides of the rectangular frame 25, plural pairs of band insertion openings 16*b* are formed in parallel so that a wrapping band can be used depending on a size of the base member. Further, the carrier member 3 has at its central portion of a lower face grooves 27 for permitting insertion of the forks of a forklift in longitudinal and lateral directions as shown in FIGS. 8 and 9.

Figure 8:
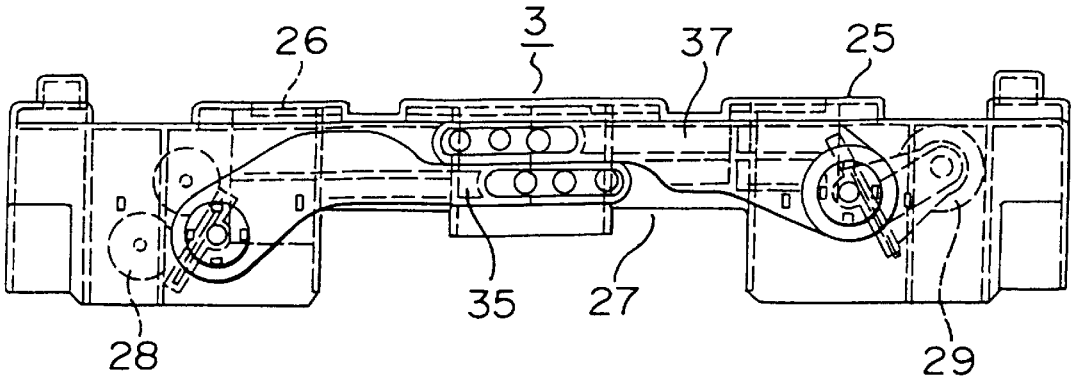
FIG. 8 is a front view of the carrier member shown in FIG. 7.
Figure 9:
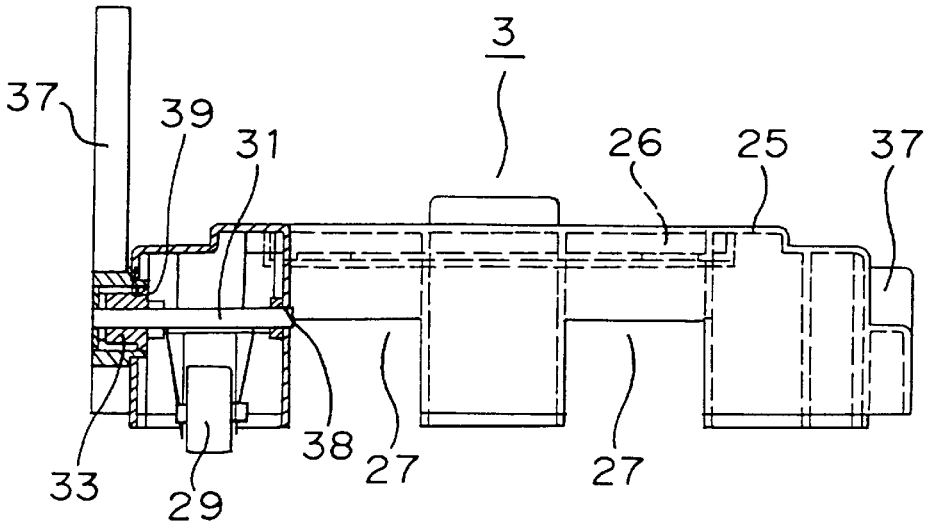
FIG. 9 is a side view partly cross-sectioned through the carrier member shown in FIG. 8.

As shown in FIG. 8, a pair of casters 28, is provided in a lower portion at a front side (a left side in the drawing) of the carrier member 3 and a pair of casters 29 is provided in a lower portion at a back side (a left side in the drawing). The casters 28 are universal casters capable of rotating in the directions of front and back and left and right. The casters 29 are one-way casters capable of rotating only in the directions of front and back.

Figure 11:
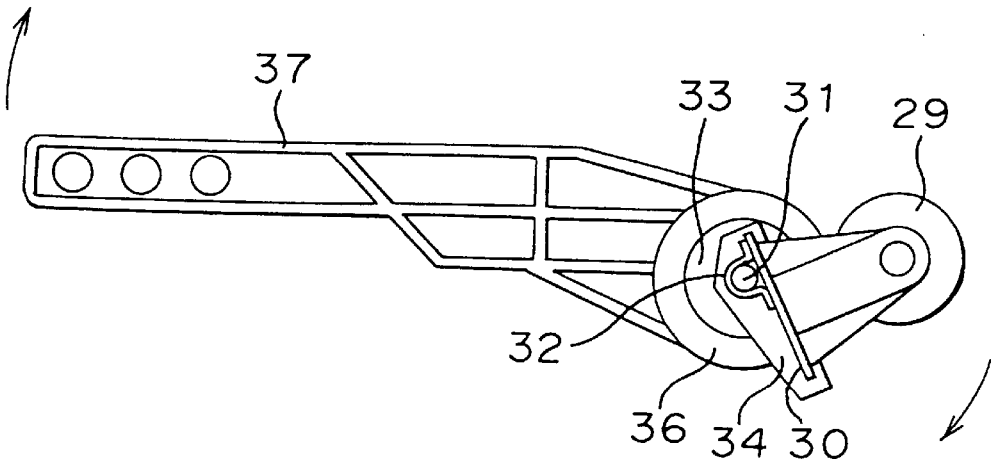
FIG. 11 is a front view showing a turning mechanism for a back side caster.

FIG. 11 shows a driving mechanism for the casters 29 provided at the back side. Each of the casters 29 is rotatably supported by each upper face plate 30 which is fixed to a supporting shaft 31 by a bearing 32. An end of the supporting shaft 31 is inserted into a bearing opening 38 formed in a rib provided at a lower portion of the carrier 3 and the other end is inserted into a bush 33 as shown in FIG. 9. A supporting plate 34 in FIG. 11 is firmly attached to the bush 33 in a substantially vertical direction. A fitting groove is formed in a side face of the supporting plate 34 and an edge of the upper face plate 30 is fitted to the fitting groove whereby the bush 33 and the caster 29 are turnable together in a direction indicated by an arrow around the supporting shaft 31.

The bush 33 firmly attached to the supporting plate 34 is fitted to a tubular bush supporter 36 which is attached to an end portion of a lever 37. The bush supporter 36 is rotatably inserted into a bearing opening 39 shown in FIG. 9 and formed at a side face of the carrier 3. Accordingly, when the lever 37 is turned upward, the caster 29 is projected from the bottom face of the carrier 3.

Figure 10:
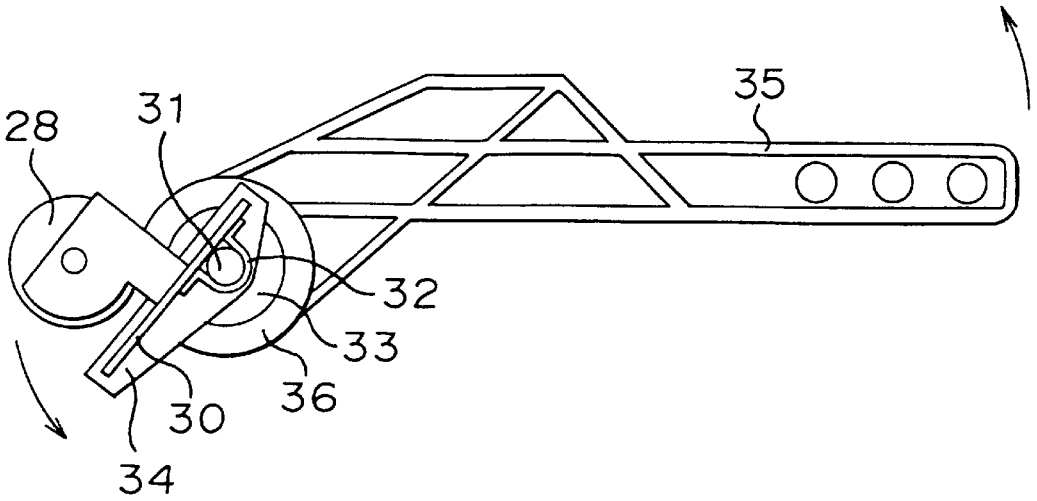
FIG. 10 is a front view showing a turning mechanism for a front side caster.

In FIG. 10, the front side caster 28 is rotatably supported by plate 30 and the upper face which is attached to a supporting shaft 31 by a bearing 32. As shown in FIG. 9, an end of the supporting shaft 31 is inserted into a bearing opening 38 formed in a rib provided at a bottom face of the carrier 3 and the other end is inserted into the bush 33 in the same manner. A supporting plate 34 in FIG. 10 is firmly attached to the bush 33 in a substantially vertical direction. A fitting groove is formed at a side face of the supporting plate 34 and a side of the upper face plate 30 is fitted to the fitting groove. Accordingly, the bush 33 and the caster 28 are turnable in a direction indicated by an arrow around the supporting shaft 31.

Figure 12:
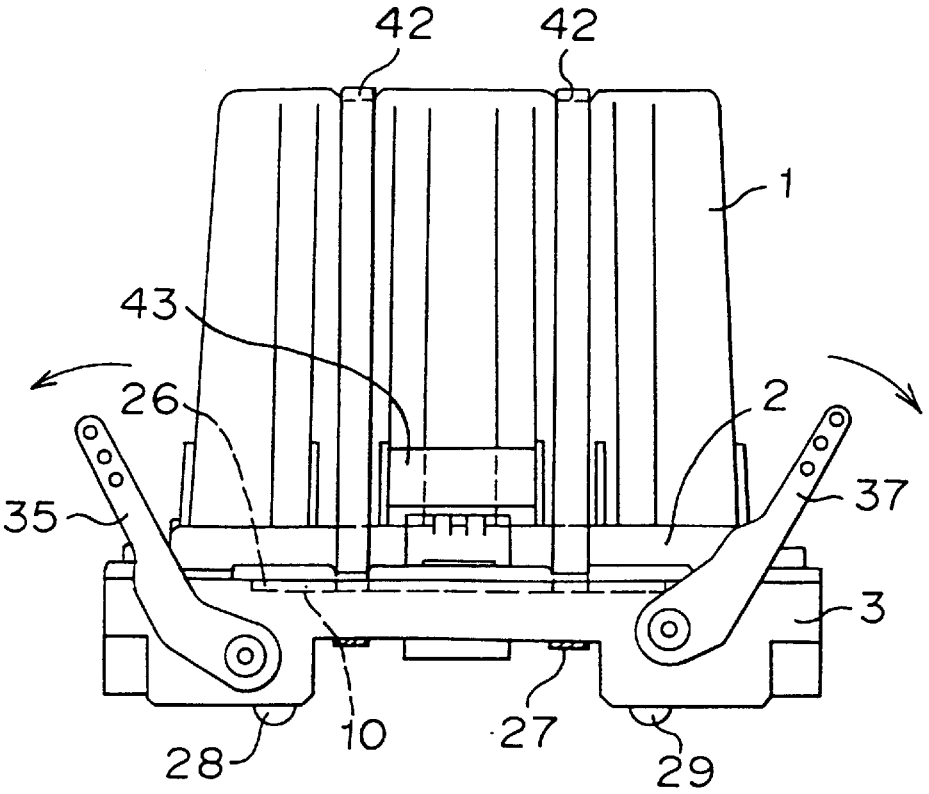
FIG. 12 shows a state in which the cover member and the base member are placed on the carrier member to be transported.

The bush 33 firmly attached to the supporting plate 34 is fitted into a tubular bush supporter 36 attached to an end of a lever 35, and the bush supporter 36 is rotatably inserted into the bearing opening 39 formed at a side face of the carrier 3 in the same manner as in FIG. 9. When the lever 35 is turned upward, the caster 28 is projected from the bottom face of the carrier 3 as shown in FIG. 12.

Figure 13:
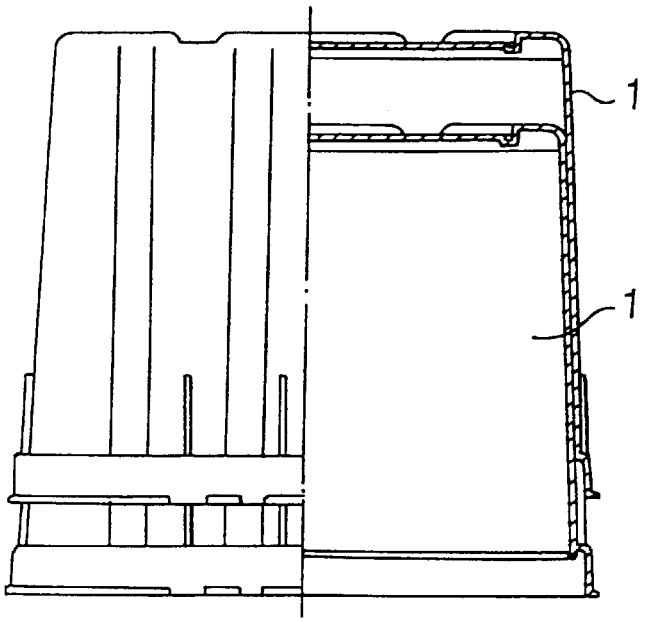
FIG. 13 shows a state in which two cover members are stacked.

When a plurality of the transportable storage containers having the above-mentioned structure are transported, for example, to a molding plant, the cover member 1, the base member 2 and the carrier member 3 are disassembled. Since the cover member 1 is in a box-like shape with its lower side opened and is flared downwardly, a plurality of the cover members 1 can be transported in a stacked state as shown in FIG. 13. Since each side surface of the cover member 1 is corrugated, stacking is easy. Further, the strength is high and a number of cover members 1 can be stacked. Also, a plurality of base members 2 can be stacked since they take a generally flat frame-like shape when the casters 28, 29 are inwardly retracted. In this embodiment, the numbers of the base member 2 can be smaller than the numbers of the cover member 1 since the carrier member 3 is usable only for transportation.

When a metallic mold is transported from a manufacturer to a molding plant, with reference to FIG. 4, the metallic mold 15 is placed on the nonslip mat 13 provided with nonslip projections 12 on the base member 2. Then, the metallic mold 15 is wrapped from its lower portion toward its upward edge by the waterproof sheet 14 fixed to the base member 2, and the upper portion of the sheet 14 is fastened with the fitting tool 20 as shown in FIG. 5. A way of fitting the fitting tool 20 is described with reference to FIGS. 5 and 6. The eyelet rings 19 provided at the periphery of the waterproof sheet 14 are inserted into the tubular insertion pieces 22 of the fitting tool 20, and then, the strip pieces 23 are bent to fit the insertion pins 24 at respective end portions of the strip pieces 23 into the tubular insertion pieces 22 whereby the fixing of the waterproof sheet 14 is completed.

Then, as shown in FIGS. 3 and 4 packaging bands are inserted into the band insertion openings 16*a* formed in the base member 2 and the metallic mold 15 is fastened with the bands to fix it to the base member 2. Then, a casing 40 in which drawings of the metallic mold, various parts for producing the metallic mold, spare parts and so on are held is placed on the metallic mold 15, and the cover member 1 is put on the base member 2. Then, the buckles 5 are engaged with the engaging projections 17 extended from the outer periphery of the base member 2 (FIG. 3).

Then, packaging bands are inserted in to the band winding grooves 9 formed in an upper surface of the cover member 1 and the band winding grooves 9 formed in the lower surface of the base member 2 to connect the cover member 1 to the base member 2 (FIG. 4). An identification card is put in a card holder 43 which is attached between adjacent ribs 6 of the cover member 1.

Figure 14:
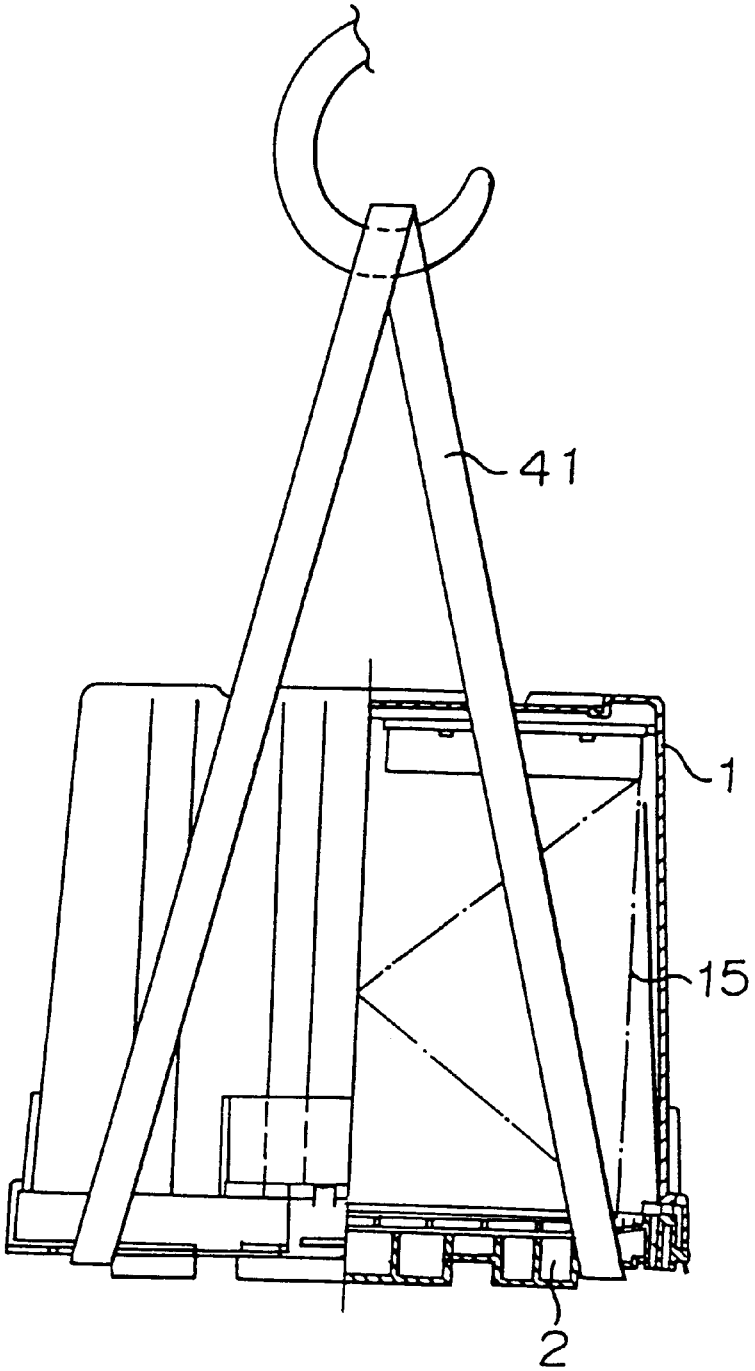
FIG. 14 is a diagram showing a state in which the cover member and the base member are assembled and hung by a crane.

As shown in FIG. 14, a hang belt 41 is wound around the bottom of the base member 2. The base member 2 mounting thereon the metallic mold 15 is hung together with the cover member 1 by a crane hook, and placed on the carrier 3 followed by detaching the hang belt (FIG. 12). Since the rectangular projection 10 is formed in the lower face of the base member 2 and the recess 26 surrounded by the rectangular frame is formed in the upper face of the carrier 3, the projection 10 is fitted thereto, whereby reliable fixing is obtainable. When required, packaging bands 42 are wound on the cover member 1 through the band insertion openings formed in the carrier 3 to fasten the cover member 1 to the carrier 3.

When a package enclosing the metallic mold is loaded on the bed of a truck, the forks of a forklift are inserted in the fork grooves 27 formed in the bottom portion of the carrier 3 to lift the carrier 3. When the package is moved to the truck by a human force, the levers 37 provided at both sides of the carrier 3 are turned upward. Then, as shown in FIG. 11, each of the tubular bush supporters 36 attached to an end portion of each of the levers 37 rotates in the bearing opening formed in each side of the carrier whereby the bush 33 fitted to the tubular bush supporter 36 is rotated. Then, the supporting plate 34 firmly attached to the bush 33 is also rotated along with the upper face plate to which the caster 29 is supported. Accordingly, the caster 29 is turned downward around the supporting shaft 31 as the center of rotation whereby the caster 29 is projected from the bottom portion of the carrier 3 as shown in FIG. 12.

Also, the casters 28 at the front side of the carrier 3 are projected from the bottom portion of the carrier 3 by turning upward the levers 35. In this case, the casters 28, 29 are turned until they come to contact with the ground beyond their lowermost points. Then, the casters 28, 29 are applied with the weight of the transportable storage container and the weight of the metallic mold, and the casters 28, 29 can automatically be locked. There is no danger of returning to the original positions without providing separately a locking mechanism. Accordingly, there is little possibility of releasing such locking state of the casters 28, 29 even when the portable storage container is transported on a rough road by a truck.

When the carrier 3 is moved by pushing the cover member 1 by hands in the state of projecting the casters 28, 29, it is easy to change a moving direction since the casters 28 are universal casters capable of rotating front and back and left and right, and the casters 29 are one-way casters capable of rotating only in the directions of front and back. When the casters 28, 29 are desired to be retracted, the levers 35 at both sides of the carrier 3 are first turned to respective horizontal positions and then, the levers 37 are turned to respective horizontal positions whereby the casters 28, 29 are received inside the carrier 3.

In a case where the metallic mold is moved from a storage site to a treating site or a side of a molding machine in a molding plant, the metallic mold can be placed on the carrier 3 with projected casters 28, 29 and the carrier 3 can be pushed by hands. Accordingly, it is unnecessary to use a pallet on which the metallic mold is placed, or a forklift, a lifter, or a crane for transportation. In this case, the fork groove 27 formed at the center of the bottom face of the carrier 3 avoids the contact of the lower portion of the carrier 3 with the ground when the carrier 3 is passed over a step or a slope end.

Figure 15:
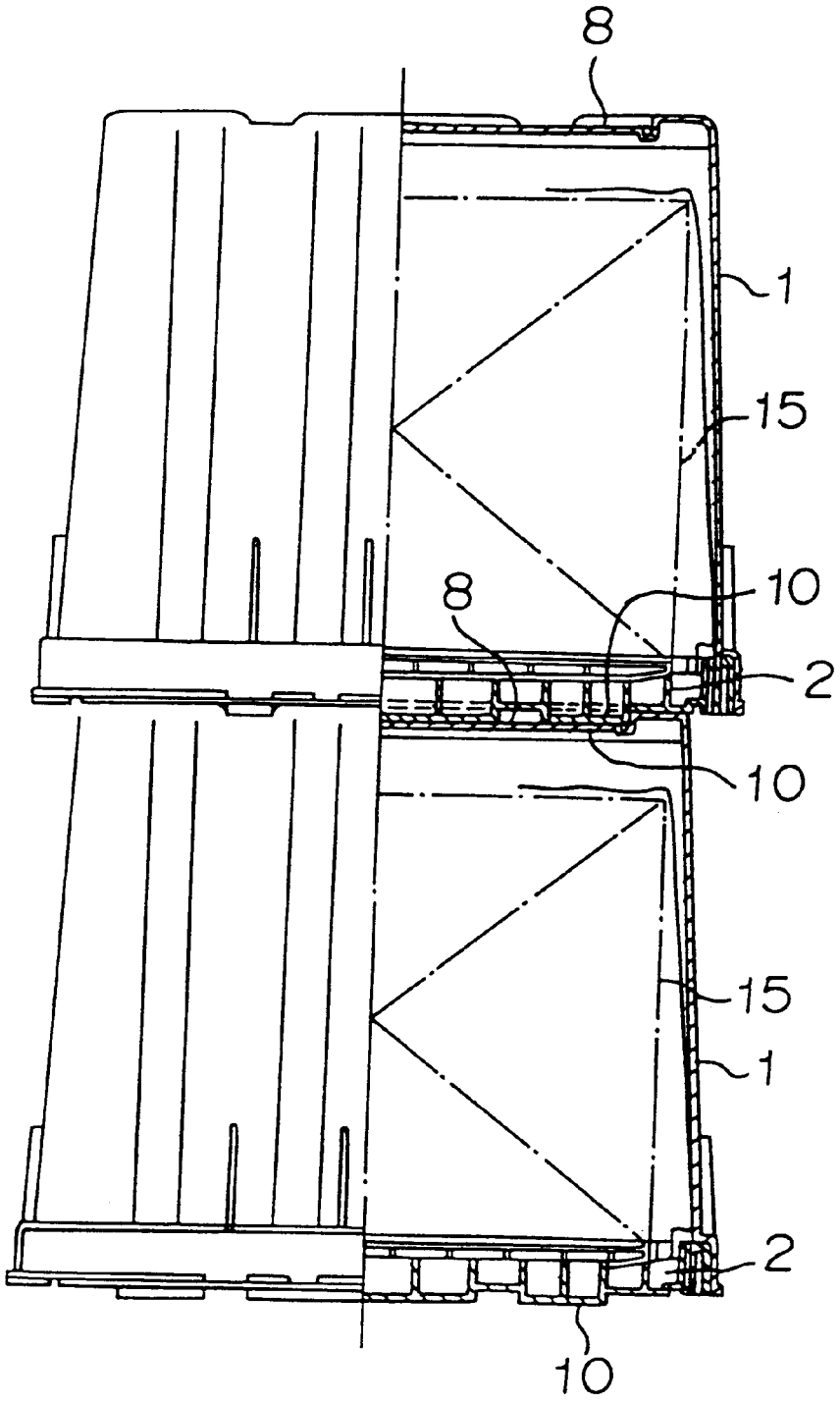
FIG. 15 shows a state in which two sets of assembled cover member and base member are stacked.

With reference to FIG. 15 when several metallic molds 15 are to be stored, several sets of the cover member 1 and the base member 2 in which each metallic mold 15 is received can be stacked. In stacking, the projection 10 formed at the lower face of the base member 2 can be fitted to the recess 8 formed in the upper face of the cover member 1 whereby stable stacking is obtainable.

In a case of FIGS. 3 and 4 where the metallic mold 15 is stored in the transportable storage container for a long time, a vapor phase inhibitor may be put inside the waterproof sheet 14. Since the vapor phase inhibitor has a heavier specific gravity than air, there is little chance of the vapor phase inhibitor being vaporized into a gaseous state and leaking even when there is a communication of air at an upper portion of the waterproof sheet 14 fastened by the fitting tool. A rust proof effect can be maintained for a long term regardless of the base member 2 having perforated band insertion openings 16*a*. Further, since the central portion of the flexible waterproof sheet 14 is clamped between the flexible plates 11*b*, 11*c*, there is no danger of breaking the waterproof sheet 14 by a direct contact of the metallic mold 15 against the waterproof sheet 14.

Even when a fire occurs, the metallic mold 15 does not get wet in fire fighting since it is surrounded by the cover member 1 and the base member 2 which closes the bottom opening of the cover member 1. Further, even when there occurs a flood disaster where the ground is under the water, there is no danger of the bulging-out of the cover member 1 due to water pressure or the coming-off of the cover member 1 from the base member 2 due to buoyancy because the lower portion of the cover member 1 is connected to the base member 2 by the buckles 5 and the lower edge of the cover member 1 is fitted to the U-shaped groove 18 in the base member 2 as shown in FIG. 4.

Even when water invades into the inside of the cover member 1, it is airtight because air inside of it is compressed to increase an inner pressure whereby the elevation of water level reaches only a predetermined level. In particular, since the metallic mold 15 is wrapped with the flexible waterproof sheet 14, the sheet 14 is brought into close contact with surfaces of the metallic mold 15 due to invading water and the volume of a lower space in the cover member 1 is increased. Accordingly, an increase of water level to the position of the fitting tool is avoidable to protect the metallic mold 15 from immersion.

Figure 16:
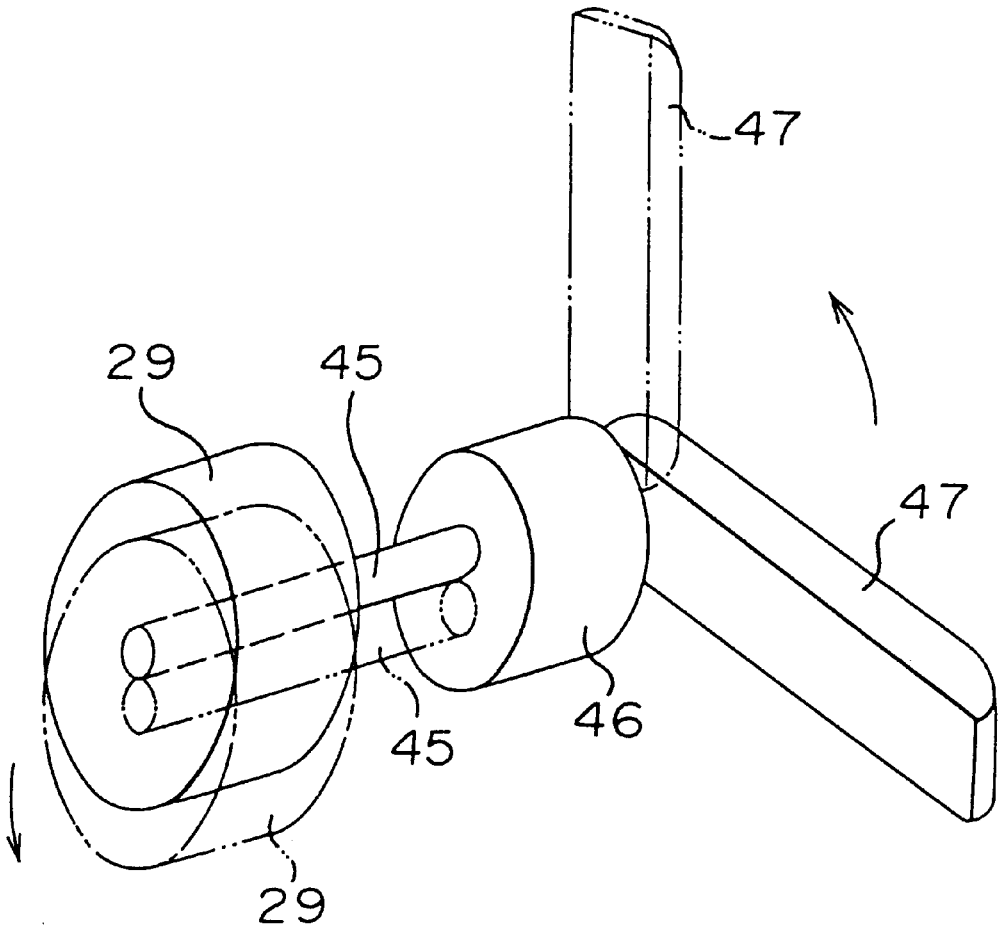
FIG. 16 is a perspective view showing another embodiment of the turning mechanism wherein a caster is supported by an eccentric shaft.

FIG. 16 shows another embodiment of the caster driving mechanism of the present invention wherein the raising or lowering of each of the casters 29 is performed by using an eccentric shaft so that the casters 29 can be projected or retracted with respect to the bottom face of the track. Specifically, a shaft 45 which supports the caster 29 is positioned offset from the center of a boss 46 which is inserted rotatably in a bearing opening formed in a side of the carrier. A lever 47 is firmly attached to a side face of the boss 46.

When the lever 47 is turned upward, a large force acts on the shaft 45 eccentrically attached to the boss 46 to turn the shaft 45. Accordingly, the caster 29 attached to the shaft 45 is projected. In this case, when the caster 29 is so arranged to move to contact the ground beyond the lowermost point, it can automatically be locked.

Alternately, the caster 29 can be projected or retracted by raising or lowering a rotary shaft to which the caster 29 is attached, in place of using the eccentric shaft 45 for raising or lowering the caster 29. Further, in the above-mentioned embodiment, an elongated lever is used to operate the caster driving mechanism. However, a pipe can detachably be attached to the mechanism to be used as the lever. Further, in the abovementioned embodiment, the band insertion openings are perforated in the base member. However, projections in which the band insertion openings are formed may be attached to an upper face of the base member. In this case, a hermetic structure is obtainable inside the cover member when it is put on the base member. Further, instead of using the fitting tool to fasten an upper portion of the waterproof sheet, a hermetic condition may be formed by fastening an upper portion of the waterproof sheet by a rope. Further, the storage casing may be formed integrally with an inner portion of the cover member.

Further, the level of the upper face on which the metallic mold is placed, on the base member may be raised so that the level of the upper face is higher than a lower edge of the cover member in an assembled state of the cover member and the base member. In this case, even when water invades into the cover member, the water level may not reach the metallic mold due to an increase of inner pressure. In the abovementioned embodiment, a case where the metallic mold is transported and stored has been described. However, the present invention is widely applicable to the transportation and storage of a heavy article such as a metallic part, a precision machine, a measuring instrument and so on.

Figure 17:
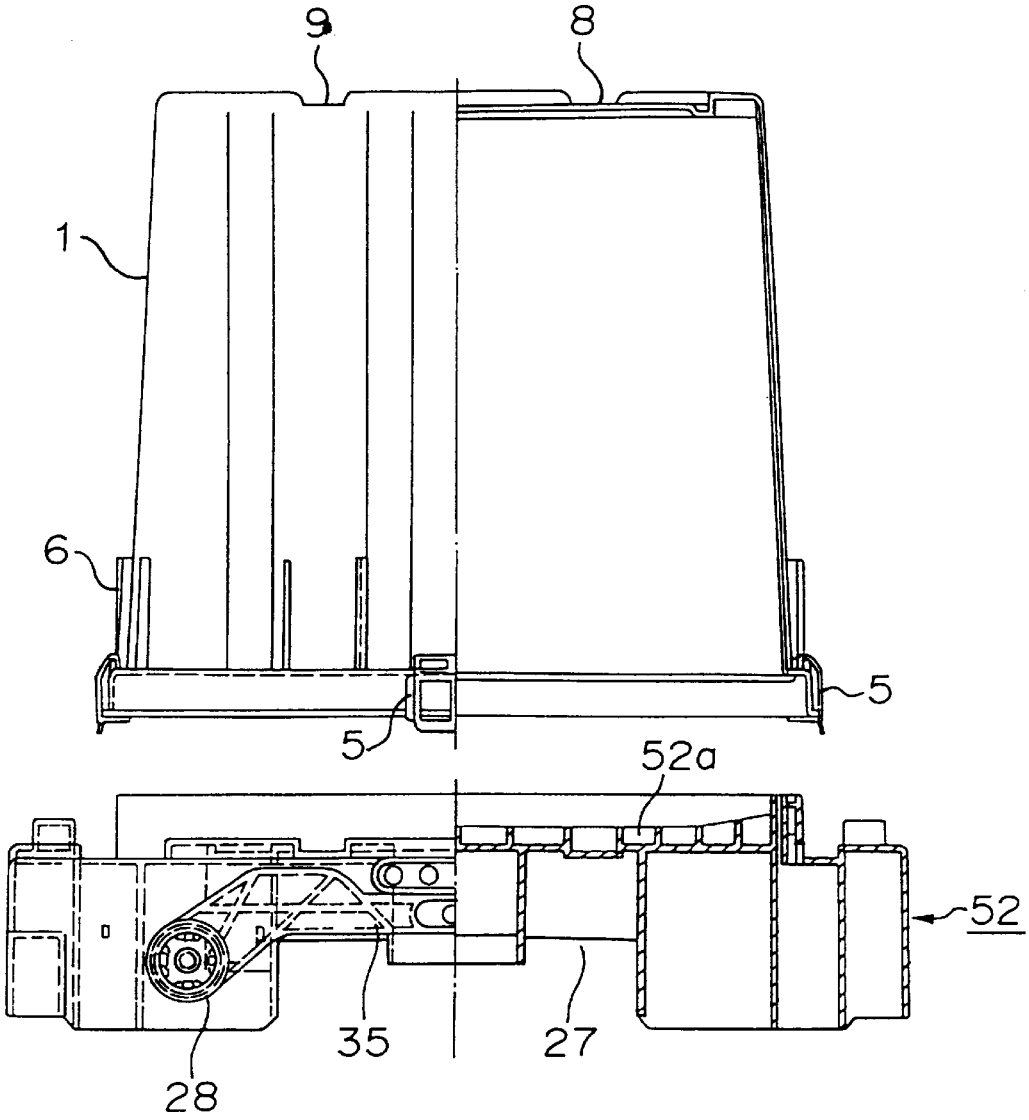
FIG. 17 is a front view of another embodiment of the transportable storage container of the present invention, wherein a cover member and a one-piece body of the base member and the carrier member are shown in a disassembled state.

FIG. 17 is a front view partly cross-sectioned for another embodiment of the transportable storage container in a disassembled state according to the present invention. The structure of this embodiment is the same as that shown in the first embodiment shown in FIGS. 1 to 15 except that the carrier member with the casters 28, is formed integrally with a base member 52. Accordingly, the same or corresponding parts are indicated by the same reference numerals, and explanation of the structure and function of these parts is omitted.

As described above, in accordance with the transportable storage container according to the present invention, a heavy article such as a metallic mold stored in the container can be protected from rusting or invasion of water into the inside of the container due to a flood in a storage site or during fire fighting activities by a combination of the cover member having an opened lower portion and the base member for closing the opened portion of the cover member.

Further, since the transportable storage container of the present invention has such a structure that the cover member 1 is fitted to the base member 52 in a vertical direction, a plurality of transportable storage containers can be stacked whereby a space for storing can effectively be utilized; arrangement and control are easy; and a warehouse having an automated system can be used.

The movement of a heavy article such as a metallic mold from a storage site to another site or a side of a molding machine is easy and damage to the metallic mold can be prevented.

Further, since the casters are provided in the carrier so as to be projected and retracted, the casters can be retracted when the portable storage container with the casters is held by a forklift or placed on the bed of a truck, and stable transportation is obtainable.

Further, since a storage casing in which drawings or the metallic mold or various parts for producing the metallic mold or spare parts are held can be contained in the container, they can be stored together with the metallic mold whereby arrangement and control can be easy.

What is claimed is:

1. A transportable storage container for an article, comprising:

an airtight cover member having an opened bottom portion;

a base member provided under the cover member so as to mount the article thereon;

a device that detachably connects the cover member to the base member; and a flexible waterproof sheet, attached to an upper face of the base member, to wrap the article mounted on the base member from a lower portion upwardly to at least a top edge of the article.

2. The transportable storage container according to claim 1, further comprising:

a vapor phase inhibitor disposed inside the waterproof sheet.

3. The transportable storage container according to claim 1, wherein the cover member is flared downwardly.

4. The transportable storage container according to claim 1, wherein the cover member includes an internal holding compartment.

5. The transportable storage container according to claim 1, wherein said waterproof sheet is flexible so as to be brought into close contact with surfaces of the article mounted on the base member to increase volume of a lower space of the cover member when water invades said lower space.

6. A transportable storage container for an article, comprising:

an airtight cover member having an opened bottom portion;

a carrier member provided under the cover member so as to mount the article thereon;

a device that detachably connects the cover member to the carrier member;

retractable casters provided at a bottom face of the carrier member; and a flexible waterproof sheet, attached to an upper face of the carrier member, to wrap the article mounted on the carrier member from a lower portion upwardly to at least a top edge of the article.

7. The transportable storage container according to claim 6, wherein the waterproof sheet includes a vapor phase inhibitor.

8. The transportable storage container according to claim 6, wherein the cover member is flared downwardly.

9. The transportable storage container according to claim 6, wherein the cover member includes an internal holding compartment.

10. The transportable storage container according to claim 6, wherein the waterproof sheet is flexible so as to be brought into close contact with surfaces of the article mounted on the base member to increase volume of a lower space of the cover member when water invades said lower space.

11. The transportable storage container according to claim 6, further comprising eccentric shafts that retract and rotate the casters.

* * * * *